US005943890A

United States Patent [19]

Field et al.

[11] Patent Number: 5,943,890

[45] **Date of Patent: *Aug. 31, 1999**

[54] CYLINDER LOCK AND KEY ASSEMBLY AND HIERARCHICAL SYSTEM THEREFOR

[75] Inventors: Peter W Field, Salem; Stan J. Sussina, Dumfries, both of Va.

[73] Assignee: Medeco Security Locks, Inc., Salem, Va.

[ * ] Notice: This patent issued on a continued prosecution application filed under 37 CFR 1.53(d), and is subject to the twenty year patent term provisions of 35 U.S.C. 154(a)(2).

[21] Appl. No.: 08/741,721

[22] Filed: Oct. 31, 1996

[51] Int. Cl.[6] ..... E05B 27/00

[52] U.S. Cl. ..... 70/493; 70/409; 70/378; 70/406; 70/369; 70/337

[58] Field of Search ..... 70/409, 493, 378, 70/357, 394, 405, 406, 384, 389, 392, 393, 337

[56] References Cited

U.S. PATENT DOCUMENTS

| | | | |
|---|---|---|---|
| 420,174 | 1/1890 | Taylor . | |
| 480,299 | 8/1892 | Voight . | |
| 484,443 | 10/1892 | Pratt . | |
| 588,026 | 8/1897 | Stadtmuller . | |
| 917,365 | 4/1909 | Schoell . | |
| 3,499,302 | 3/1970 | Spain et al. | 70/406 |
| 3,722,240 | 3/1973 | Spain et al. | 70/419 |
| 4,142,389 | 3/1979 | Bahry et al. | 70/359 |
| 4,235,086 | 11/1980 | Genakis | 70/494 |
| 4,450,699 | 5/1984 | Genakis | 70/494 |
| 4,553,452 | 11/1985 | Keller | 70/411 |
| 4,635,455 | 1/1987 | Oliver | 70/409 |
| 4,723,427 | 2/1988 | Oliver | 70/494 |
| 4,932,229 | 6/1990 | Genakis | 70/494 |
| 4,998,426 | 3/1991 | Genakis | 70/494 |
| 5,176,015 | 1/1993 | Sussina | 70/369 |
| 5,419,168 | 5/1995 | Field | 70/494 |
| 5,438,857 | 8/1995 | Kleinhaeny | 70/493 |
| 5,582,050 | 12/1996 | Häggström | 70/495 |
| 5,682,779 | 11/1997 | Dolev | 70/494 |

FOREIGN PATENT DOCUMENTS

| | | | |
|---|---|---|---|
| 0210037 | 1/1987 | European Pat. Off. . | |
| 0599805 | 6/1994 | European Pat. Off. . | |
| 3119626 | 2/1982 | Germany . | |
| 3136314 | 3/1983 | Germany | 70/406 |
| 3302138 | 9/1984 | Germany . | |
| 3542008 | 4/1987 | Germany . | |
| 4036158 | 6/1991 | Germany . | |
| 9211896 | 4/1993 | Germany . | |
| 29508840 | 8/1995 | Germany . | |
| 9428273 | 8/1994 | WIPO . | |

*Primary Examiner*—Darnell M. Boucher
*Attorney, Agent, or Firm*—Rothwell, Figg, Ernst and Kurz

[57] ABSTRACT

A lock mechanism has at least one tumbler pin having one or more slots in the tip surface of the pin and a key blade which is formed with a projection extending from the surface of the bitting area. The tumbler pin can be rotatable in such a manner that it will seek to accommodate the projection on the surface of the key and to match the surfaces of the key and tumbler pin tip, thus aligning the tumbler pin at a position predetermined by the key bitting. In this regard, the tumbler pin tip is preferably tapered and adapted to engage with a key having a complementarily shaped bitting surface, i.e., complementary to the tapered surface of the tumbler pin tip, such that the tumbler pin will seek to accommodate the tapered surface of the key bitting to align the tumbler pin at a proper position. Alternatively, the tumbler pin can include a projection or the like to inhibit rotation of the tumbler pin. Cylinders and keys according to the present invention can be arranged in hierarchical systems to perform special functions and provide master keying capability.

25 Claims, 6 Drawing Sheets

CYLINDER LOCK AND KEY ASSEMBLY AND HIERARCHICAL SYSTEM THEREFOR

BACKGROUND OF THE INVENTION

1. Field of the Invention

This invention relates generally to improvements in cylinder lock and key assemblies and, more particularly, to tumbler pin and key bitting surface designs and to hierarchical lock and key systems.

2. Description of the Prior Art

Yale type cylinder locks are well known and have been in continuous use since 1865. In such locks, key differs are usually developed by adjusting the lengths of a set tumbler pins and the corresponding bitting depths on a corresponding key.

Typically, the tips of the tumbler pins which contact the key bittings are frustoconical or chisel pointed. Examples of such known tumbler pin tip configurations are seen in U.S. Pat. No. 4,289,002 (Gretler), U.S. Pat. No. 4,325,241 (Keller), U.S. Pat. No. 4,760,722 (Fann et al.), and U.S. Pat. No. 5,176,015 (Sussina).

Other variations in the shapes of tumbler tips are also known in the art. For example, U.S. Pat. No. 420,174 (Taylor) shows a master-key lock wherein the lower ends of the lower pins 12 are provided with two dissimilar operative surfaces, which are adapted to be engaged by different keys, creating a master-key system. Similar tumbler pin tip variations are also seen in U.S. Pat. No. 588,026 (Stadtmuller), U.S. Pat. No. 480,299 (Voight), and U.S. Pat. No. 484,443 (Mouat et al.). As another example, U.S. Pat. No. 917,365 (Schoeil) shows a security lock wherein tumbler pins are provided in coaxial pairs and wherein a special key is provided which is capable of moving both pins of the coaxial pair in order to raise the pins to their appropriate height. In particular, by inserting the proper key, the upper bittings 12 enter slots 11 and engage the lower ends of the inner pins 6, while the lower bittings 14 engage the lower ends of the outer pins 5.

Pin tips and corresponding keys are also known which are shaped to adjust the position of the tumbler pin during insertion of the key into the lock. For example, U.S. Pat. No. 3,499,302 (Spain et al.) shows tumbler pins with chisel-shaped tips which are rotatable to predetermined positions by skew cut key bittings to operate in conjunction with a side bar mechanism. In addition, U.S. Pat. No. 4,450,699 (Genakis) shows a tumbler pin having a groove 32' which engages a skewed key ridge 62. These patents show is locks wherein the tumbler pins are adjusted rotationally in addition to the traditional elevational positioning. More recently in U.S. Pat. No. 4,635,455 (Oliver), the tip of a chisel-pointed tumbler pin has been offset, increasing the theoretical bitting and combination possibilities of a six-pin tumbler cylinder.

In addition, a number of techniques have been developed to arrange lock cylinders and their associated keys in hierarchical systems. U.S. Pat. No. 369,628 (Van Hoevenbergh) illustrates segmented pin tumblers disposed in one or more columns which allow several keys which are bitted differently from each other to operate a single cylinder. U.S. Pat. No. 420,174 (Taylor), discussed above, discloses non-rotatable pins with contact key bitting surfaces of different heights to permit different keys to operate the same cylinder. U.S. Pat. No. 564,803 (Stadtmuller) discloses tumbler pins having dual vertical key contact surfaces operable by different keys. U.S. Pat. No. 567,305 (Donovan) provides master keying capability through variations in the shape of the key profile and the corresponding keyway in the cylinder. U.S. Pat. No. 567,624 (Taylor) provides keying capability by using plate tumblers for changing the tumbler-key contact area which allows different keys to operate the same cylinder. In addition, U.S. Pat. No. 3,349,587 (Keller) discloses a method of positional master keying. Cylinders also have been constructed which cooperate with different keys to allow for selective rotation of the barrels. See, for example, U.S. Pat. No. 4,107,966 (Schlage) which discloses a cylinder that is partially operated by one key to retract a latchbolt, and is fully operated by another key to retract the latchbolt and a deadbolt. Some lock systems include interchangeable core cylinders which are operable by a control key, permitting a quick exchange of the core containing the tumblers for a core operated by a different key. See also the prior art classified in class 70, subclass 369 in the U.S. Patent and Trademark Office. Further, some lock cylinders are operable by a first key, but are adjusted when operated by a second key so as to render the cylinders operable only by the second key. See U.S. Pat. No. 3,099,151 (Schlage) and the prior art classified in class 70, subclass 383 in the U.S. Patent and Trademark Office. The above-mentioned patents are only some examples of cylinders that are operable with different keys.

Despite the many hierarchical lock systems known in the art, there remains a need for new and improved lock cylinders that can be operated by more than one key. For example, in large buildings and institutions, cylinders and keys are often arranged in master-keyed systems for the convenience of management personnel.

The positioning of tumbler pins by unique keys has been the subject of continuous improvement in the lock art. Patents issued for the great majority of lock cylinders now on the market have expired. Their keys can be copied on conventional machines of the type described in U.S. Pat. No. 1,439,382 (Segal). The key blanks required are widely distributed beyond the control of the lock manufacturer. The development of skew cut bittings, e.g. Spain et al. discussed above, provided additional security to the key owner because conventional rotary machines could not duplicate these angled cuts. However, because there have been machines developed to duplicate skew cut bittings, their security has been reduced. Uniquely shaped bittings and controlled distribution of proprietary key blanks reduce the odds that keys in the possession of dishonest employees, etc., can be copied at hardware stores and the like.

Notwithstanding existing improvements in the well-worked lock arts, there remains a need for lock systems which provide a large number of unique keys which are not subject to unauthorized duplication. There is also a need for lock mechanisms which resist contemporary lock picking techniques, such as impressioning methods to obtain false keys. It is also desirable that the dimensions of the lock not exceed conventional cylinder size. It is equally important that the components can be economically mass produced.

SUMMARY OF THE INVENTION

This invention provides an extraordinary large number of key differs using elevationally and possibly rotationally movable locking tumbler pins which have high resistance to picking, do not exceed the limitations of industry standards, and are compatible for mass production.

These and other objectives are accomplished, at least in part, by a lock mechanism which uses at least one tumbler pin having one or more slots in the tip surface of the pin and a key blade which is formed with a projection extending from the surface of the bitting area.

According to one embodiment of the invention, the tumbler pin is rotatable in such a manner that it will seek to accommodate the projection on the surface of the key and to match the surfaces of the key and tumbler pin tip, thus aligning the tumbler pin at a position predetermined by the key bitting. In this regard, the tumbler pin tip is preferably tapered and adapted to engage with a key having a complementarily shaped bitting surface, i.e., complementary to the tapered surface of the tumbler pin tip, such that the tumbler pin will seek to accommodate the tapered surface of the key bitting to align the tumbler pin at a proper position.

Cylinders and keys according to the present invention can be arranged in hierarchical systems to perform special functions and provide master keying capability. The present invention provides unique lock cylinder mechanisms that can be operated by different keys. The locking mechanisms are highly resistant to picking, are dimensionally compatible with industry standards, and are suitable for mass production.

One hierarchical system of the present invention includes lock cylinders having at least one tumbler pin with a first type slot and a key with a complimentary tab on a bitting surface which mates with the slot of the tumbler pin tip as described above.

The present invention also includes a partially manufactured key in the form of a key blank with a bitting surface pre-manufactured therein. The bitting surface is shaped according to the present invention for engaging a complementarily shaped tumbler pin tip.

According to one aspect of the invention, an assembly for a cylinder lock is provided which includes a tumbler pin having a receiving slot in an end thereof, the receiving slot being narrower than a diameter of the tumbler pin and extending inward partly across the tumbler pin, and the end having a slanted surface which is angled to a center axis of the tumbler pin, a key having a bitting surface for receiving the end of the tumbler pin, the bitting surface including a slanted surface corresponding to the slanted surface of the tumbler pin, and a projection extending upward from the bitting surface, the projection being fittable within the slot with the slanted bitting surface and the slanted surface of the tumbler pin against one another in an engaged position, whereby when biased against one another in a cylinder lock, the tumbler pin will seek to assume the engaged position with the projection fitted within the slot and the slanted surfaces against one another.

According to another aspect of the invention, the slot is substantially narrower than a diameter of the tumbler pin.

According to another aspect of the invention, a method of positioning a tumbler pin in a cylinder lock includes the steps of: a) providing a cylinder lock with a tumbler pin having a receiving slot at one end, the end having a slanted surface which is angled to a center axis of the tumbler pin, b) providing a key having a bitting surface for receiving the end of the tumbler pin, the bitting surface including a slanted surface corresponding to the slanted surface of the tumbler pin, and a projection extending upward from the bitting surface, c) inserting the key into the cylinder lock to contact the slanted surface of the pin against the slanted surface of the key such that the tumbler pin assumes an engaged position with the projection fitted within the slot and the slanted surfaces resting against one another.

According to another aspect of the invention, the method further includes the steps of: providing the tumbler pin with a second slanted surface opposite to the slanted surface, the slanted surfaces converging toward the end of the tumbler pin, providing the receiving slot in one of the slanted surfaces and providing another receiving slot in the other of the slanted surfaces, and during the step c) of inserting the key into the cylinder lock, contacting either of the slanted surfaces of the tumbler pin against the slanted surface of the key such that the tumbler pin assumes an engaged position with the projection fitted within either of the slots regardless of the initial orientation of the tumbler pin.

According to another aspect of the invention, a hierarchical system is provided including: a first cylinder lock having a tumbler pin with a receiving slot at one end, the tumbler pin being axially movable within the cylinder lock to an unlocking position, a first key having a bitting for receiving the end of the tumbler pin, the bitting having a bitting surface corresponding to the end of the tumbler pin and a projection extending upward from the bitting surface; the first cylinder lock having a key slot, the first key being insertable to an inserted position in the key slot at which the projection fits within the slot and the bitting surface contacts the end of the tumbler pin such that the tumbler pin is maintained in the unlocking position; a master key having a bitting for receiving the tumbler pin, the master key bitting having a bitting surface corresponding to the end of the tumbler pin and matching the bitting surface of the first key without the projection of the first key; the master key being insertable to an inserted position in the key slot at which the bitting surface of the master key contacts the end of the tumbler pin such that the tumbler pin is maintained in the unlocking position; wherein both the first key and the master key are configured to operate the first cylinder.

According to another aspect of the invention, a key blank for a hierarchical system of locks and keys wherein there are at least two different locks and two different keys, a first key operating less than the total number of locks and a second key operating more locks than the first key, each of the keys including a key bow, a key blade connected to the key bow, the key blade being configured in cross-section to fit into the keyway of at least some of the locks and shaped to have bittings formed in it so as to operate some of the locks, is provided which includes: the key blank having at least one bitting surface pre-cut thereon, the bitting surface including a slanted surface corresponding to a slanted surface of the tumbler pin and a projection extending upward from the bitting surface and having a width narrower than the bitting surface for cooperating with at least one complementarily shaped tumbler pin tip, so that when inserted into a lock the pre-cut bitting surface causes the tumbler pin to rotate about its axis and to be positioned to a proper unlocking location, the key blank having an additional bitting surface at least some of which is plain and not pre-cut so that additional cuts on the blank may be made by locksmiths to operate additional pin tumblers in the lock.

According to another aspect of the invention, a key for operating a cylinder lock having a plurality of tumbler pins, the key having a key blade with a plurality of bitting surfaces formed thereon which engage the tumbler pins to operate the cylinder lock, is provided which includes: a key bow, a key blade with a top surface and a bottom surface and having a length and a longitudinal axis extending along the length, the key blade having first and second side edges extending along the length of the key blade substantially parallel to the longitudinal axis and the key blade having a width extending between the first and second side edge, substantially transverse to the longitudinal axis, a plurality of bitting surfaces formed in the key blade, the bitting surfaces being configured to engage a plurality of tumbler pins of a cylinder lock such that the key operates the cylinder lock, and wherein at least one of the bitting surfaces is formed with a slanted surface corresponding to a slanted surface of a tumbler pin and a projection extending upward from the bitting surface and having a width narrower than the bitting surface for cooperating with at least one complementarily shaped tumbler pin tip, the bitting surface extending across the width of the key blade.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention is illustrated by way of example and not limitation in the accompanying drawings, in which like references indicate like parts, and in which.

DETAILED DESCRIPTION OF THE PREFERRED EMBODIMENTS

The FIGS. illustrate a number of embodiments of improved cylinder locks and keys. In addition to providing unique individual locks and keys, the various embodiments can be used to create hierarchical systems using one or more of the embodiments (as discussed below).

Figure 1:
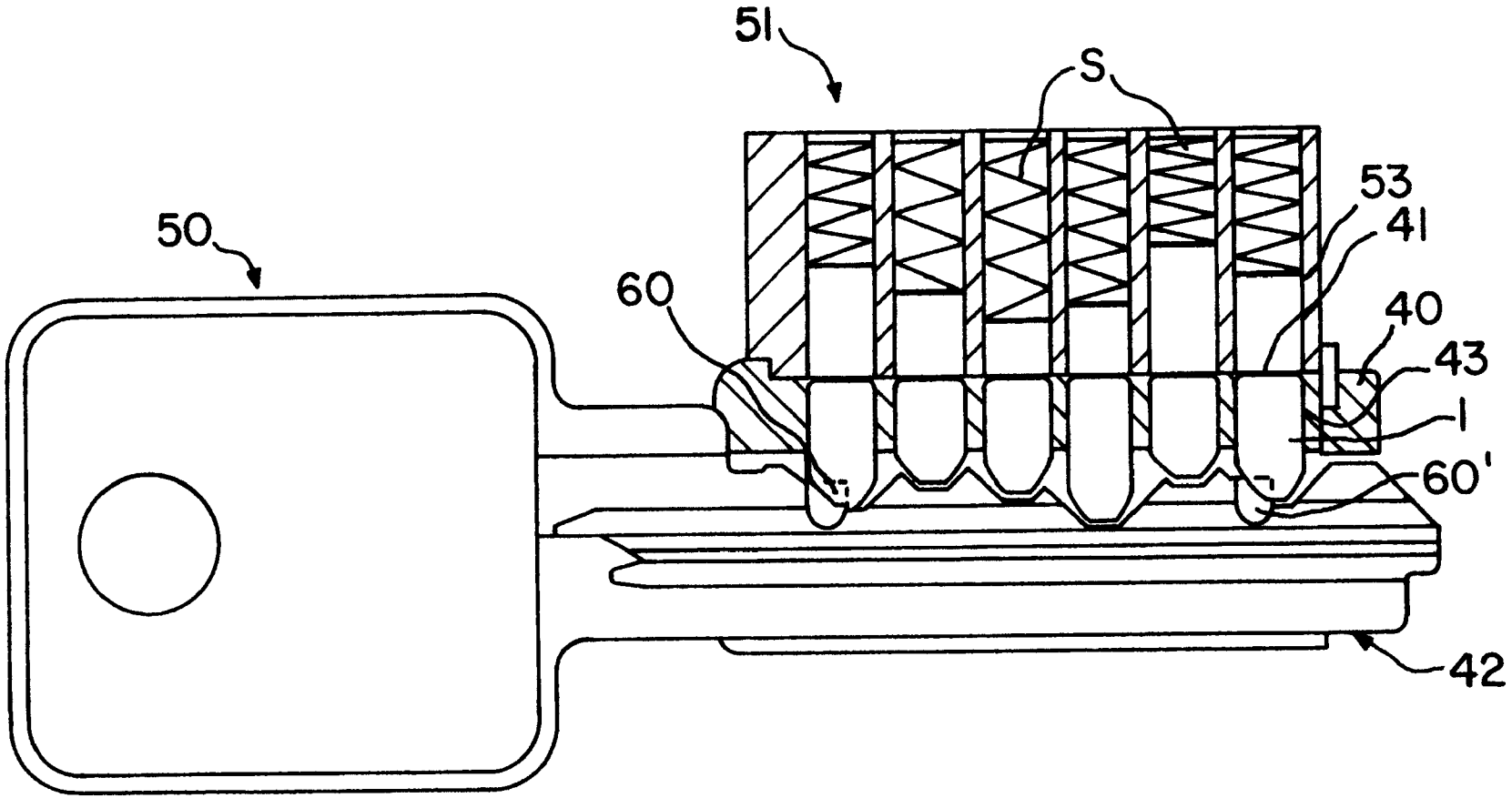
FIG. 1 is a side elevational view, partially in cross section, of an improved cylinder lock and key according to a first embodiment of the invention.

FIG. 1 illustrates a first embodiment of an improved cylinder lock having cylinder 51 and a key 50. The cylinder 51 has a rotatable hub or barrel 40 having a key receiving slot 42 therein. The cylinder 51 and the barrel 40 each include a plurality of bores 53, 43 which are aligned when in the position shown in FIG. 1 and which include respective upper and lower sets of pins therein, the upper pins being urged downward by respective springs S as shown. It should be noted that the present invention is not limited to any one particular type of lock. The lock shown in FIG. 1 is merely exemplary. For example, the upper pins can be biased by springs, gravity, magnetic or other means as known in the art. In addition, although FIG. 1 illustrates a set of six tumbler pins, it should be apparent that the number of pins can be varied. In the position illustrated in FIG. 1, a proper key 50 is inserted in the cylinder 51 such that all of the lower pins are elevated to the shear line 41, coincidental with the outer diameter of the barrel 40. In this state, the key 50 can rotate the barrel 40 relative to the cylinder 51 in a manner known in the art.

Figure 2A:
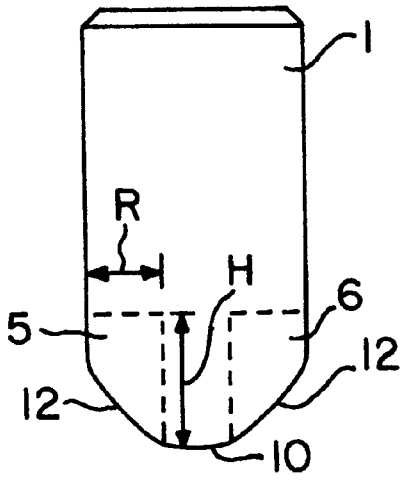
FIG. 2(A) is a side elevational view of the tumbler pin shown in FIG. 1.
Figure 2B:
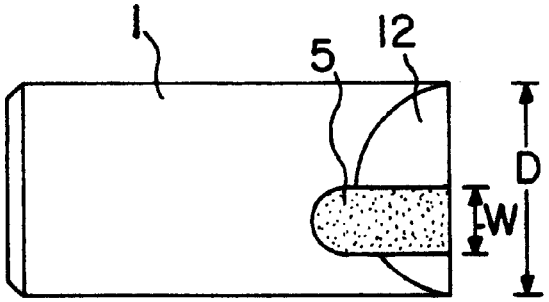
FIG. 2(B) is a side view of the tumbler pin shown in FIG. 1 in horizontal orientation and rotated approximately ninety degrees from the view in FIG. 1.
Figure 2C:
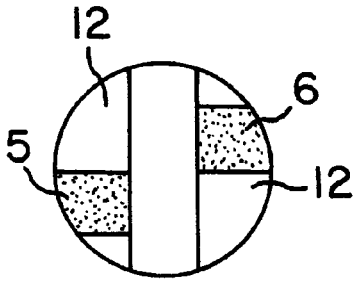
FIG. 2(C) is a bottom view showing the tip of the tumbler pin of FIG. 1.

FIGS. 2(A)–2(C) more closely illustrate the preferred construction for a modified tumbler pin 1 according to the first embodiment of the present invention. It is contemplated that one or more of the tumbler pins in the lower set is a modified tumbler pin 1. As shown in FIG. 2(C), the tumbler pin 1 preferably has a generally circular or cylindrical shape, and, as shown in FIG. 2(A), the tumbler pin 1 also preferably includes a chisel pointed end 10 formed by two tapered surfaces 12. As best shown in FIGS. 2(B)–2(C), each surface 12 is preferably generally flat.

The modified tumbler pin 1 is formed with a slot 5 at its lower end. The slot 5 is preferably formed in the tumbler pin at a location along one of the surfaces 12. As explained further below, a second slot 6 is also preferably included to accommodate different orientations of the pin. The width W of the slot 5 is preferably substantially smaller than the diameter D of the tumbler pin 1. The depth R, the height H, and the width W of the slot are preferably sufficient to receive a projection 60 of a key 50 (as discussed below). The width W is also preferably narrower than the width of the key blade. The dimension R of the slot 5 is preferably less than the radius of the pin, i.e. D/2.

Figure 4A:
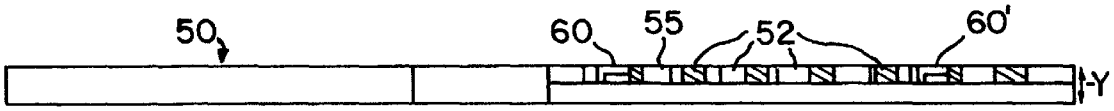
FIG. 4(A) is a top view of the key shown in FIG. 1.
Figure 4B:
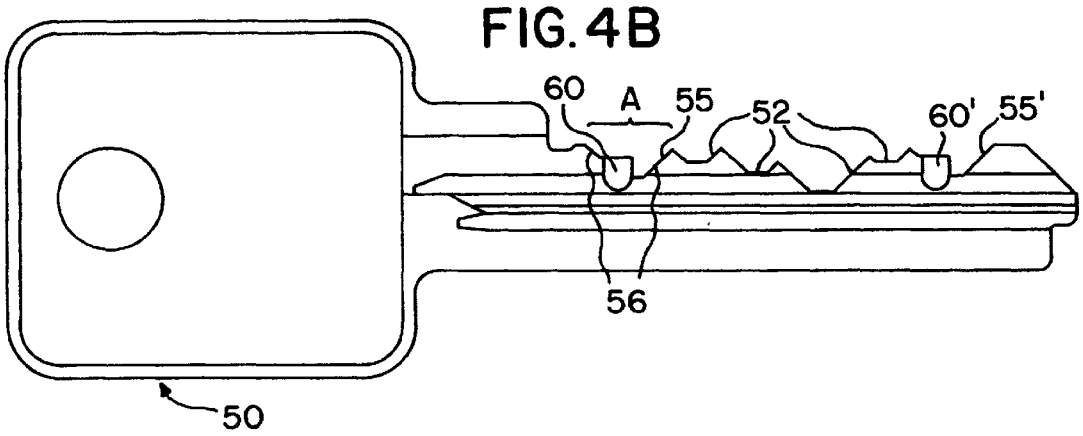
FIG. 4(B) is an side elevational view of the key shown in FIG. 1.
Figure 5A:
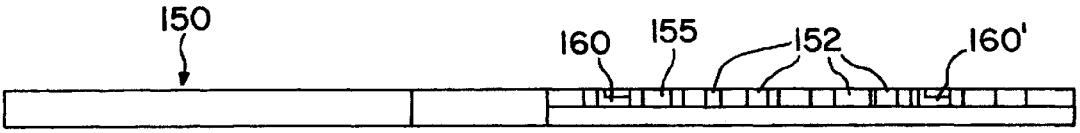
FIG. 5 is a top view of a key for use with the tumbler pin shown in FIG. 3(A) according to the second embodiment of the invention.
FIG. 5(B) is a side elevational view of the key shown in FIG. 5(A)
Figure 5B:
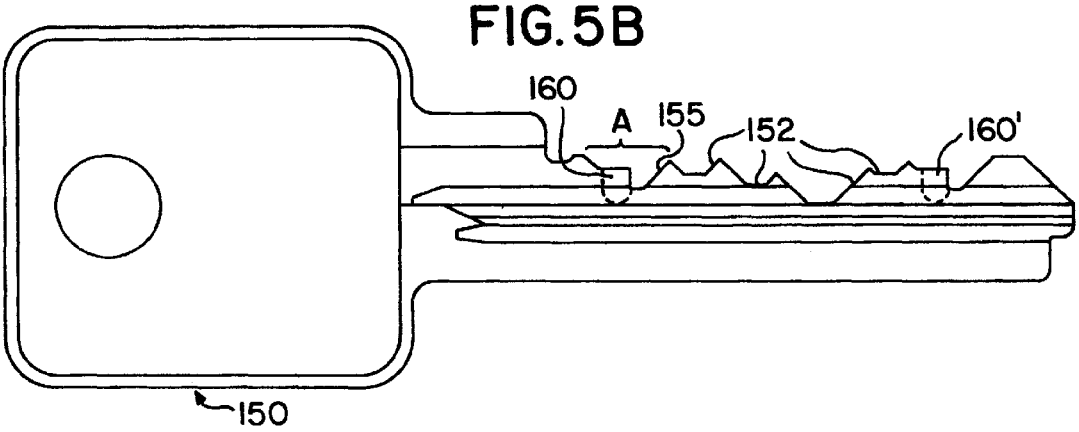

As shown in FIGS. 4(A)–4(B), the key 50 includes a number of common bittings 52, an improved bitting 55 having a projection 60 extending within the bitting area A, and another similar improved bitting 55' which has a similar projection tab 60'. As shown in FIG. 1, when the key 50 is inserted into the barrel 51, the projection tabs 60 and 60' are appropriately accommodated within the slots 5 or 6 (as discussed below) so as to appropriately locate the top of the pins along the shear line 41. As shown in FIGS. 2(B)–2(C), the slot 5 is offset from the center line of the tumbler pin and as shown in FIG. 4(A) the projection tab 60 is located at, or proximate, one side (the upper side as shown in FIG. 4(A)) of the bitting 55. As a result, the projection tab will only enter the slot if the slot is appropriately aligned with the projection tab, as is the case with the key 50 and the pins 1 shown in FIG. 1. It is contemplated that at least one improved bitting 55 should be included. If desired, all of the bittings can be improved bittings 55. The common bittings 52 incorporated are preferably cut completely across the full width of the top edge of the key blade. Appropriate common bittings and respective pins are shown in U.S. Pat. No. 5,176,015 (Sussina), the disclosure of which is incorporated herein by reference, including pins 4 and conventional bittings on a key 20. As should be understood, the common bittings and respective pins can be of any known type.

Figure 3A:
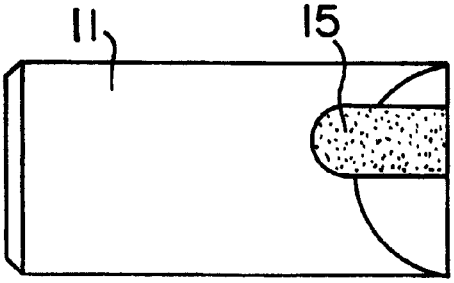
FIG. 3(A) is a side elevational view, similar to FIG. 2(B), illustrating a tumbler pin according to a second embodiment of the invention.

It is contemplated that the width of the slot 5 can be varied. In addition, the location of the slot 5 can be varied along the diameter of the pin, e.g. along the surface 12, and accordingly the projection tab 60 can also be selectively located across the width Y of the key. In this manner, different keys and cylinders can be produced by varying the tab and slot locations, by incorporating additional projection tabs 60, etc. In this regard, a second embodiment of the key and pin construction illustrating alternative locations of the projection tab and slot is shown in FIGS. 3(A)–3(B) and 5(A)–5(B). The key 150 is similar to the key 50 shown in FIGS. 4(A)–4(B) except for the positioning of the projection tabs 160. As shown, the projection tab 160 is located on the opposite side of the width Y of the key, e.g. of the bitting, than the projection tab 60 shown in FIG. 4(A). Similarly, the slot 15 of the tumbler pin 11 shown in FIG. 3(A) is also offset toward the opposite side of the tumbler pin. As should be understood from the figures, the projection tab 60 of the key 50 would only align with the slot 5 of the pin 1 and not with the slot 15 of the pin 11. Likewise, the projection 160 of the key 150 would not align with the tumbler pin 1. It should be understood that locks (and associated keys) can be made with various combinations of the tumbler pins 1 and 11, and/or with additional types of pins formed with different slot locations, as desired, and that the first and second embodiments are shown for illustrative purposes only.

Operation of the key and tumbler pin engagement will now be described with reference to the key 50 and the tumbler pin 1, as an illustrative example. When the key 50 is inserted into the slot in the barrel 40, the tumbler pin 1 which is freely rotatable within the bore in the barrel, rotates as at least one of its tapered tip surfaces 12 contacts a sloped surface of the bitting 55. As a result, the tumbler pin 1 rotates until at least one tapered surface 12 of the pin 1 rests against a tapered surface of the bitting 5—the tumbler pin 1 naturally seeking to accommodate such a position. The tumbler pin 1 will, thus, seek a position with the projection 60 engaged within the slot of the tumbler pin 1. In the engaged position, preferably the lower end of the tumbler pin rests on the surface of the bitting 55. The action by which the tumbler pin 1 seeks such a position can be enhanced by vertically orienting the pin 1 such that gravitational force biases the surfaces together. Additionally, springs S, other biasing means, etc., within the cylinder lock can also be used to facilitate this positioning, or seating, action.

Figure 3B:
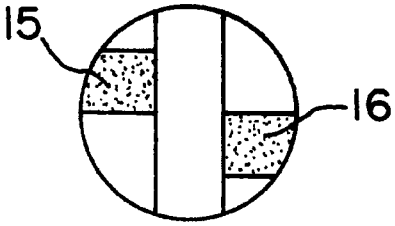
FIG. 3(B) is a bottom view, similar to FIG. 2C, of the embodiment of FIG. 3A.

As shown in FIGS. 2(A) and 2(C) and as discussed above, the tumbler pin 1 preferably includes a second slot 6 on the opposite side of the tumbler pin 1. The slot 6 is situated such that when the tumbler pin 1 is rotated 180° it will assume the initial position of the slot 5. In this manner, the tumbler pin 1 can be freely rotated without the need for additional means to ensure that the slot aligns with the projection tab. That is, depending on the initial orientation of the tumbler pin 1, either the slot 5 or the slot 6 will seek to align with the projection tab 60. As shown in FIG. 3(B), the tumbler pin 11 also preferably includes a similar second slot 16.

Figure 6:
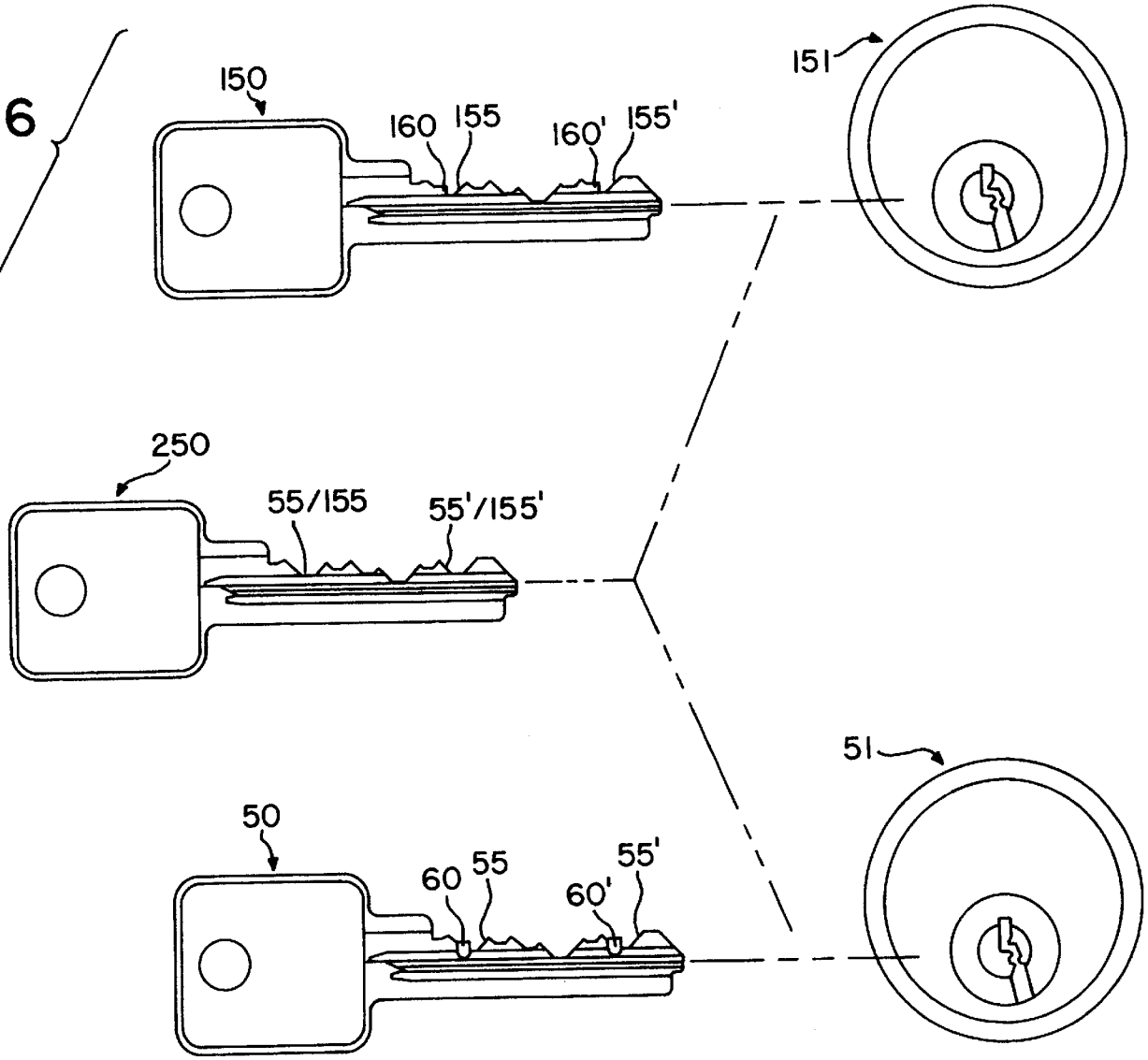
FIG. 6 is a schematic diagram of a pair of lock cylinders and keys according to the first and second embodiments used together in a hierarchical system.

FIG. 6 illustrates one embodiment of a hierarchical lock and key system according to the present invention, utilizing both the first and second embodiments of the key and tumbler pin designs discussed above—e.g. using keys 50 and 150 and cylinders 51 and 151. In this system, the upper bitting surface, defined by all of the bittings, on both of the keys 50 and 150 are substantially identical, except for the widthwise locations of the projection tabs 60, 60' and 160, 160'. With this similarity in the upper surfaces of the keys, a master key 250 having an upper surface substantially like that of the keys 50 and 150 can be provided in order to operate both of the cylinders 151 and 51. The bitting areas 55/155 and 55'/155' of the master key 250 are formed substantially like the bitting areas 55, 55' and 155, 155' of the keys 50 and 150, respectively, without the projection tabs therein. Accordingly, the master key 250 operates both of the cylinders 51 and 151, while the key 50 does not operate the cylinder 151 and the key 150 does not operate the cylinder 51. For example, the tumbler pin 1 would rest on top of the projection tab 160 of the key 150.

Although a hierarchical system has been described utilizing two separate key types 50 and 150 and a master key 250, it should be understood that such a hierarchical system is merely exemplary. For example, additional keys can be created having different projection locations across the width of the key blade such that, for example, three or more corresponding locks could be provided which would be operated by the same master key. It is noted that the complexity of the hierarchical system could be further modified as desired, such as designing a number of submaster keys useable with a portion of a total number of key cylinders, and a master key usable with all of the cylinders. For example, such a design could be created by including tumbler pins and projections at more than one bitting area.

Figure 7A:
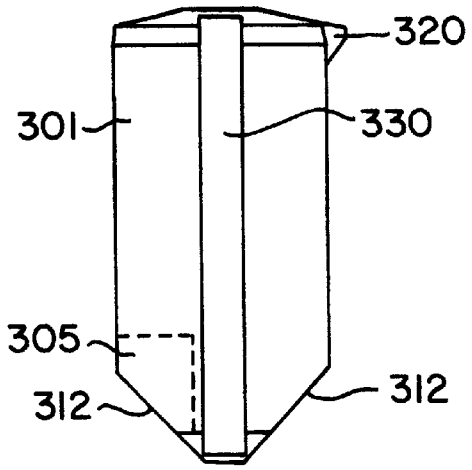
FIGS. 7(A)–7(C) are views similar to FIGS. 2(A)–2(C), respectively, showing an alternative tumbler pin construction.
Figure 7B:
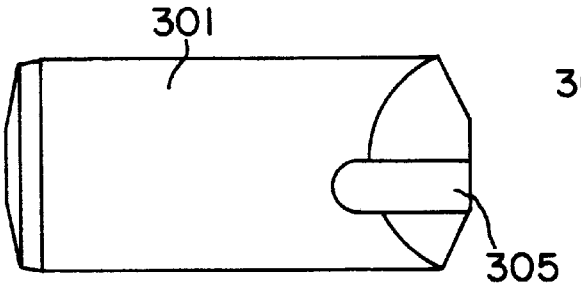
Figure 7C:
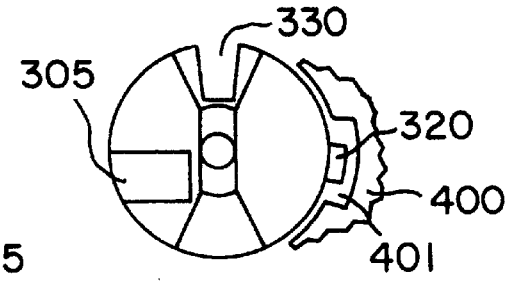

FIGS. 7(A)–7(C) show an alternative embodiment including a tumbler pin 301. In this alternative construction, the tumbler pin 301 is prevented from completely rotating around its center axis by the inclusion of a projection 320 on the side of the tumbler pin 301 which is fitted within an axial guide slot 401 in the barrel 400, shown in broken form in FIG. 7(C). Due to the projection 320 and the guide slot 401, only one receiving slot 305 is needed. In addition to this preferred construction, other rotation limiting devices can be used in order to allow the pin to have only one receiving slot—for example, the pin can be formed with a square cross-section, etc.

Figure 10:
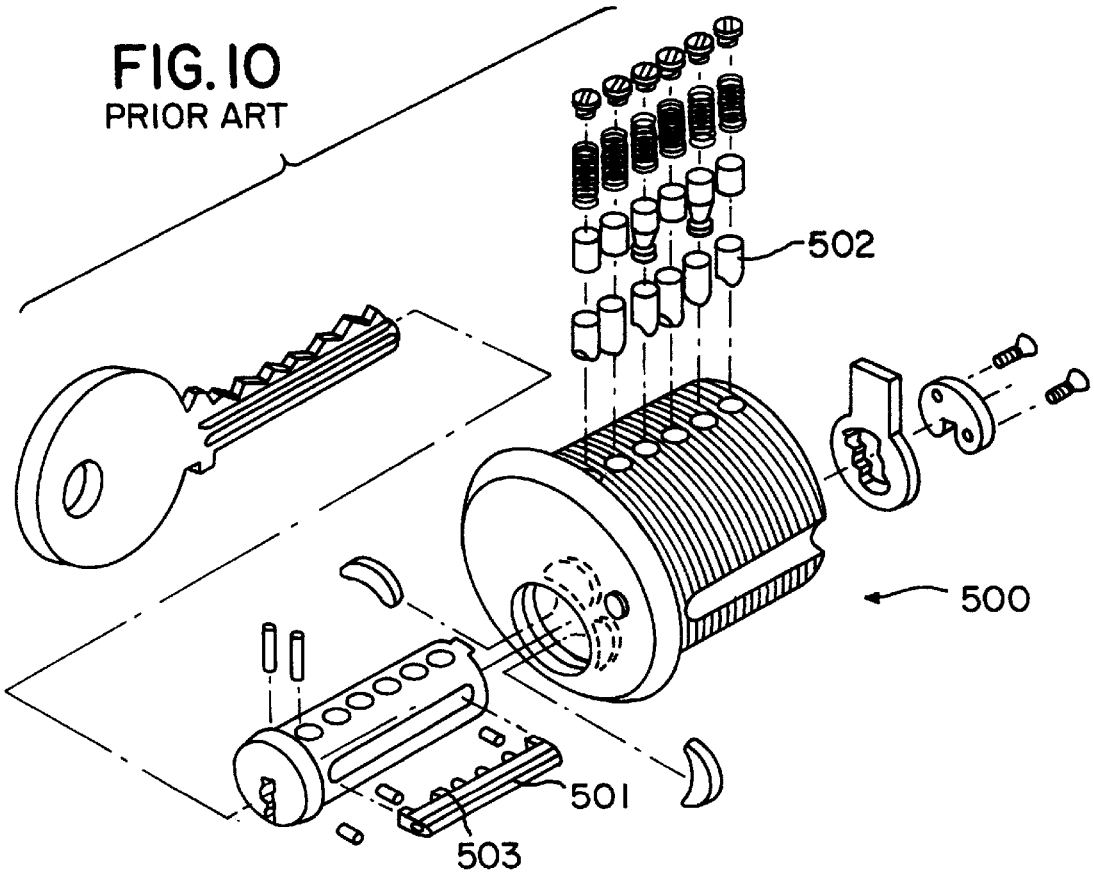
FIG. 10 PRIOR ART
FIG. 10 is a perspective view of a known Medeco® type cylinder lock.

The tumbler pin 301 illustrated in FIGS. 7(A)–7(C) also shows another alternative feature of the invention. In particular, the slot 401 can be made wide enough to allow for some rotation of the tumbler pin 301, such that a tumbler slot 330 along the length of the tumbler pin will be appropriately aligned when contacted by a proper bitting surface of the key inserted. The tumbler slot 330 is usable in a lock system such as the prior art Medeco® type high security lock 500 shown in FIG. 10 which utilizes rotatably and elevationally positionable tumbler pins as described in U.S. Pat. No. 3,499,302 to Spain et al., the disclosure of which is herein incorporated by reference, wherein a fence or side bar 501 requires proper rotation of tumbler pins 502 for alignment of the tumbler slots with the side bar legs 503 as shown in FIG. 10.

Figure 8A:
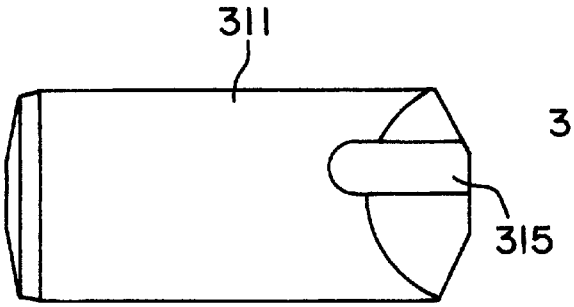
FIGS. 8(A)–8(B) are views similar to FIGS. 3(A)–3(B), respectively, showing another alternative tumbler pin construction.
Figure 8B:
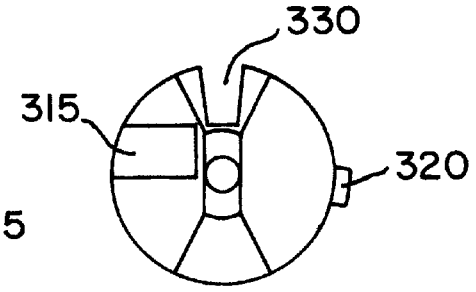

The tumbler pin 301 shown in FIGS. 7(A)–7(C) also preferably includes tapered surfaces 312 corresponding to the bitting surfaces of the key, similar to surfaces 12 of the embodiment shown in FIGS. 2(A)–2(C). As shown in FIGS. 8(A)–8(B), the tumbler pin 301 can be modified, as with the above-noted tumbler pins, so as to place the slot at a different location in order to provide a variety of lock types.

Figure 9A:
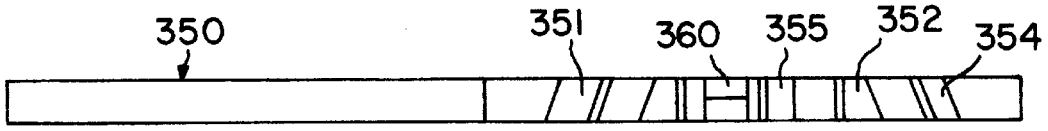
FIGS. 9(A)–9(B) are views similar to FIGS. 4(A)–4(B) and FIGS. 5(A)–5(B) illustrating an alternative key construction.
Figure 9B:
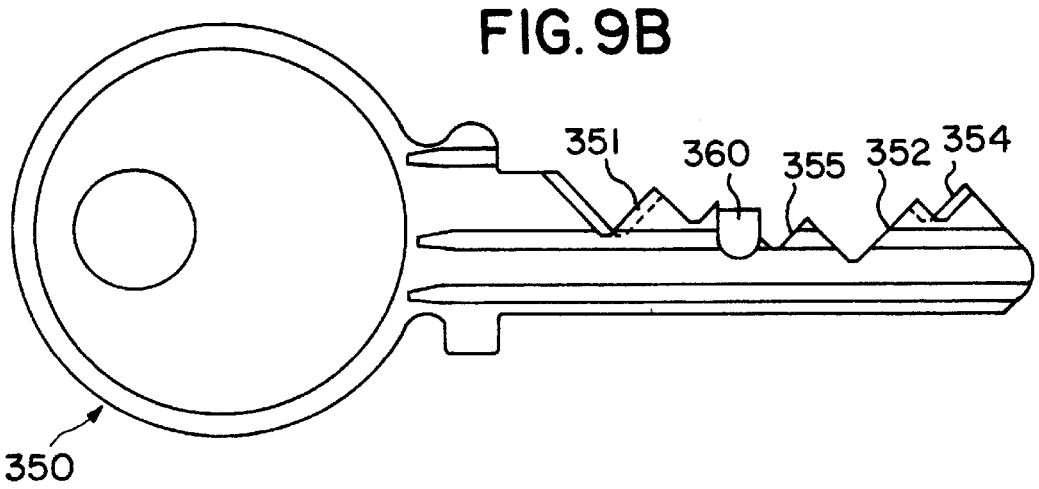

FIGS. 9(A)–9(B) show an exemplary embodiment of a key 350 for operating a lock having an appropriately located tumbler pin 301. As shown, the bitting 355 contains a corresponding projection tab 360. As should be apparent, this key and tumbler pin can operate in a like manner to the above-noted keys and tumbler pins in order to receive the projection tab 360 within the slot 305. As illustrated, key 350 includes skew cut bittings 351 and 354 of the type taught by Spain et al. noted above. Accordingly, the tumbler pins associated with the skew cut bittings could include appropriate tumbler slots, similar to slot 330 shown in FIG. 7(A), cooperating with side bar legs, e.g. legs 503 shown in FIG. 10.

The present invention can be readily obtained by modifying existing systems so as to include the appropriate projections and tumbler pin slots for receiving the projection. As shown, the projections 60, 160 and 360 preferably include a generally horizontal upper surface and a generally vertical front surface at approximately right angles to one another. However, it is contemplated that the shape of the projection tabs can be modified, as long as the function of the projection tabs remains the same and as long as the tumbler pins relatively freely align the appropriate slot and projection tab when a proper key is inserted. The projection tab is preferably formed at the side of the bitting towards the portion of the key held by one's hand. However, it is contemplated that the position of the projection and the relative position of the slot can be modified as long as the concepts of the invention are not departed from. Furthermore, although the illustrated key bittings according to the preferred embodiments include generally planar outer tapered walls and a generally flat bottom surface between the tapered walls, it is contemplated that the shape of the key bittings can be altered. For example, the tapered walls can be curved, somewhat irregularly shaped, etc., and can even contact one-another without a horizontal lower surface (the tumbler pins being appropriately modified), as long as the underlying concepts of the invention are not departed from.

It will be appreciated by those skilled in the art that the exemplary hierarchical system of locks and keys described above and shown schematically in FIG. 6 is but one very simplified application of the present invention. Further, those skilled in the art will readily recognize that the present invention can be applied to hierarchical lock and key systems of many different sizes and which include various types of locks, keys, and combinations thereof. Moreover, it is within the scope of the present invention to utilize conventional techniques for masterkeying, key differing, key changing and core removal combined with the novel complementarily shaped tumbler pin tips and key bitting surfaces.

Although the present invention has been described with reference to particular embodiments, it is to be understood that the embodiments are merely illustrative of the application of the principles of the invention. Numerous configurations may be made therewith and other arrangements may be devised without departing from the spirit and scope of the invention.

What is claimed is:

1. An assembly for a cylinder lock, comprising:

a tumbler pin having a receiving slot in an end thereof, said receiving slot being narrower than a diameter of said tumbler pin and extending inward partly across said tumbler pin, and said end having a slanted surface which is angled to a center axis of said tumbler pin;

a key having a bitting surface for receiving said end of said tumbler pin, said bitting surface including a slanted surface, that is at an angle to a longitudinal axis of said key, corresponding to said slanted surface of said tumbler pin, and a projection extending upward from said bitting surface;

said projection being fittable within said slot with said slanted bitting surface and said slanted surface of said tumbler pin against one another in an engaged position;

whereby when biased against one another in a cylinder lock, the tumbler pin will seek to assume said engaged position with the projection fitted within said slot and said slanted surfaces against one another.

2. The assembly of claim 1, wherein said slot is narrower than a diameter of said tumbler pin.

3. The assembly of claim 1, wherein a second receiving slot is located on an opposite side of said end from said receiving slot.

4. The assembly of claim 1, further including means for limiting rotational movement of said tumbler pin with respect to said key.

5. The assembly of claim 4, wherein said limiting means includes a limiting projection extending from the perimeter of said tumbler pin.

6. The assembly of claim 5, wherein said limiting projection has a width narrower than a width of said bitting surface.

7. The assembly of claim 1, wherein said slanted surface of said tumbler pin converges toward said axis in the direction of said end such that said end has a chisel shape.

8. The assembly of claim 7, wherein said end includes a second slanted surface opposite to said first slanted surface.

9. The assembly of claim 8, wherein said slot is located within one of said slanted surfaces of said tumbler pin.

10. The assembly of claim 9, wherein a second slot is located on the other of said slanted surfaces of said tumbler pin.

11. The assembly of claim 10, wherein at least one of said slanted surfaces of said tumbler pin is planar.

12. A method of positioning a tumbler pin in a cylinder lock, comprising the steps of:

a) providing a cylinder lock with a tumbler pin having a receiving slot at one end, said end having a slanted surface which is angled to a center axis of said tumbler pin;

b) providing a key having a bitting surface for receiving said end of said tumbler pin, said bitting surface including a slanted surface, that is at an angle to a longitudinal axis of said key, corresponding to said slanted surface of said tumbler pin, and a projection extending upward from said bitting surface;

c) inserting the key into the cylinder lock to contact the slanted surface of said pin against the slanted surface of said key such that the tumbler pin assumes an engaged position with the projection fitted within said slot and said slanted surfaces resting against one another.

13. The method of claim 12, wherein said step a) further includes forming the receiving slot narrower than a diameter of the tumbler pin and extending inward partly across said tumbler pin.

14. The method of claim 12, further including the step of providing a second receiving slot on an opposite side of said end than said receiving slot.

15. The method of claim 12, further including the step of limiting rotational movement of said tumbler pin with respect to said key.

16. The method of claim 15, wherein said step of limiting rotational movement includes providing a projection extending from the perimeter of said tumbler pin.

17. The method of claim 12, further including the step of providing said projection with a width narrower than a width of said bitting surface.

18. The method of claim 12, further including the steps of:

providing said tumbler pin with a second slanted surface opposite to said slanted surface, said slanted surfaces converging toward said end of said tumbler pin;

providing said receiving slot in one of said slanted surfaces and providing another receiving slot in the other of said slanted surfaces; and during said step c) of inserting the key into the cylinder lock, contacting either of said slanted surfaces of said tumbler pin against the slanted surface of said key such that the tumbler pin assumes an engaged position with the projection fitted within either of said slots regardless of the initial orientation of the tumbler pin.

19. The assembly of claim 1, wherein said center axis of said tumbler pin is generally perpendicular to said longitudinal axis of said key.

20. The assembly of claim 1, wherein said center axis of said tumbler pin is substantially vertical and said longitudinal axis of said key is substantially horizontal.

21. The assembly of claim 1, wherein said bitting surface is generally V-shaped with said slanted surface forming one side of said V-shape and another slanted surface forming another side of said V-shape.

22. The assembly of claim 21, wherein said bitting surface includes a generally flat base surface transverse to and between said slanted surfaces, said base surface extending substantially parallel to said longitudinal axis of said key.

23. A key adapted for operating a cylinder lock, the key comprising:

a key bow;

a key blade with a top and a bottom and having a length and a longitudinal axis extending along said length, the key blade having first and second side edges extending along the length of the key blade substantially parallel to said longitudinal axis and the key blade having a width extending between the first and second side edge, substantially transverse to said longitudinal axis;

a plurality of bittings formed in the key blade, said plurality of bittings being adapted to engage a plurality of tumbler pins of a cylinder lock such that the key operates the cylinder lock; and wherein at least one of said plurality of bittings includes a slanted surface for corresponding to a slanted surface of a tumbler pin and a vertical projection extending upward from said at least one bitting and having a lateral width narrower than a width of said at least one bitting for cooperating with at least one complementary shaped tumbler pin tip, said at least one bitting extending laterally across the width of said key blade, and said vertical projection extending partially across a lateral dimension of said bitting and extending partially across a longitudinal dimension of said bitting.

24. The key of claim 23, wherein each said at least one bitting includes another slanted surface facing said slanted surface and a bottom surface extending between said slanted surfaces.

25. The key of claim 24, wherein said vertical projection connects only to one of said slanted surfaces and to said bottom surface.

* * * * *